US007350723B2

(12) United States Patent
Reedy

(10) Patent No.: US 7,350,723 B2
(45) Date of Patent: Apr. 1, 2008

(54) CORDLESS, SELF-CONTAINED, HANDHELD SPRAY GUN

(75) Inventor: Tony Reedy, Aubrey, TX (US)

(73) Assignee: Just A Simple Thing, Inc, Aubrey, TX (US)

( * ) Notice: Subject to any disclaimer, the term of this patent is extended or adjusted under 35 U.S.C. 154(b) by 0 days.

(21) Appl. No.: 10/878,929

(22) Filed: Jun. 28, 2004

(65) Prior Publication Data

US 2005/0284963 A1 Dec. 29, 2005

(51) Int. Cl.

| | |
|---|---|
| ***B05B 9/04*** | (2006.01) |
| ***B05B 9/01*** | (2006.01) |
| ***B05B 7/02*** | (2006.01) |
| ***B05B 1/28*** | (2006.01) |

(52) U.S. Cl. ..... 239/332; 239/67; 239/296; 239/300; 239/308; 239/376; 239/526; 239/DIG. 14

(58) Field of Classification Search ..... 239/332, 239/67, 296, 300, 308, 376, 526, DIG. 14, 239/68, 69, 290, 294, 302–304, 306, 307, 239/373, 378, 527; 118/692, 712, 683–685
See application file for complete search history.

(56) References Cited

U.S. PATENT DOCUMENTS

| | | | | |
|---|---|---|---|---|
| 2,121,924 A * | 6/1938 | Newlin | 239/300 |
| 2,228,226 A * | 1/1941 | Downs | 239/300 |
| 2,613,995 A * | 10/1952 | Reinhold | 239/351 |
| 2,629,539 A * | 2/1953 | Drewes, Jr. | 417/419 |
| 2,717,804 A * | 9/1955 | White, Jr. | 239/308 |
| 3,236,459 A * | 2/1966 | McRitchie | 239/416 |
| 3,880,356 A * | 4/1975 | Chandler | 239/308 |
| 4,030,665 A * | 6/1977 | Koyama | 239/373 |
| 4,174,071 A * | 11/1979 | Lau et al. | 239/348 |
| 4,301,971 A * | 11/1981 | Cornelius et al. | 239/351 |
| 5,069,389 A * | 12/1991 | Bitsakos | 239/289 |
| 5,152,460 A * | 10/1992 | Barty | 239/290 |
| 5,526,981 A * | 6/1996 | Sanson | 239/8 |
| 6,845,924 B2 * | 1/2005 | Schmon | 239/526 |

* cited by examiner

*Primary Examiner*—Darren Gorman

(57) ABSTRACT

What is disclosed is a self contained, cordless, handheld spray gun (100). The spray gun (100) comprises a fluid container (225) in intercommunication with at least one fluid nozzle orifice (201) and a source of pressurized gas (204) in intercommunication with at least one gas nozzle orifice 207 and one fan nozzle orifice (227). The spray gun (100) is actuated by pulling a trigger (231) that opens at least one valve (202) so that the fluid, such as paint, primer, stain, varnish, sealant or the like, can flow to a fluid chamber (206), atomized, and sprayed through a fluid nozzle orifice (201) out onto the article to be painted.

18 Claims, 2 Drawing Sheets

CORDLESS, SELF-CONTAINED, HANDHELD SPRAY GUN

FIELD OF THE INVENTION

Figure 1:
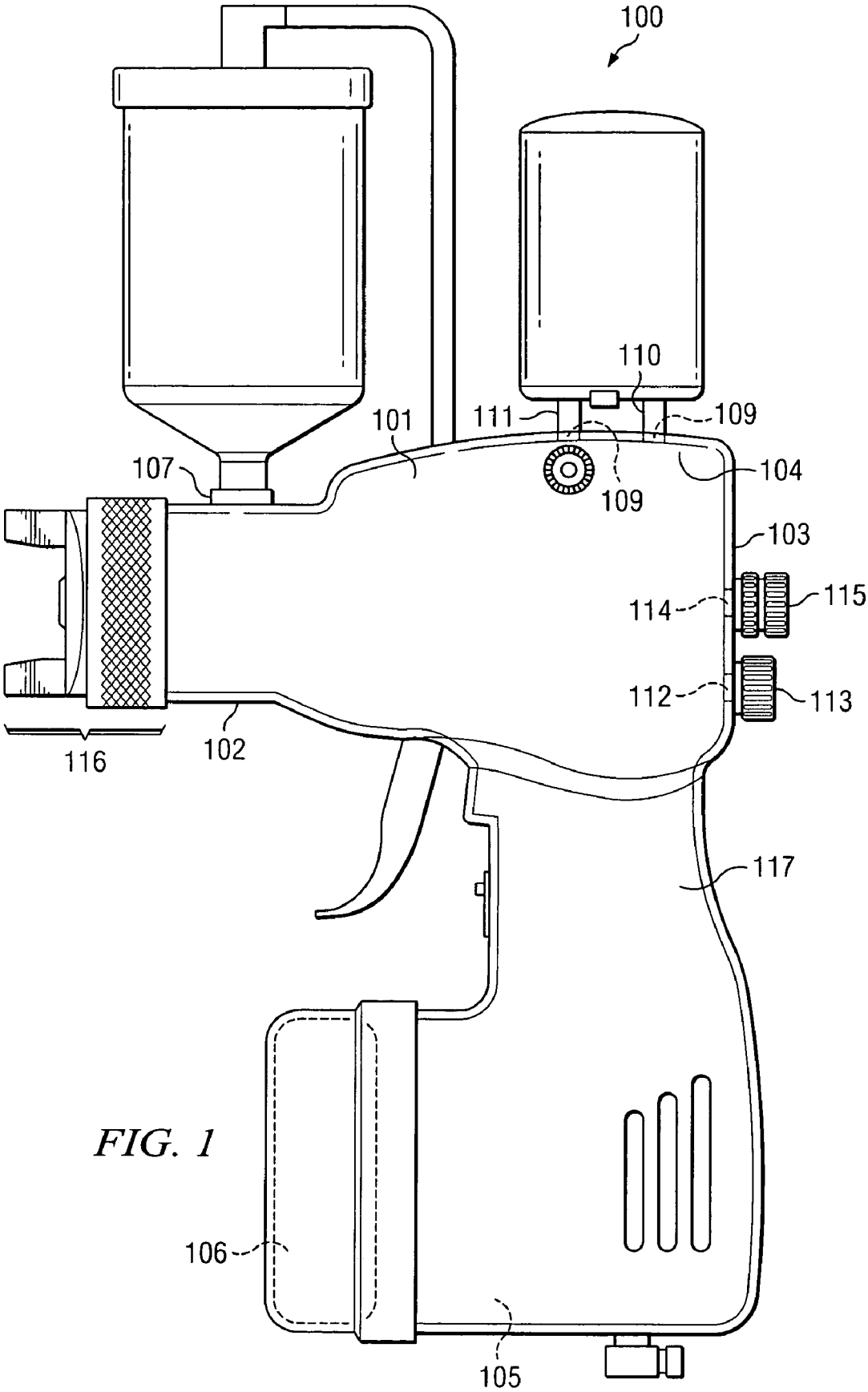

The present invention generally pertains to spray guns and related devices adapted to spray fluids, such as paints, primers, stains, varnishes, sealants and the like. More specifically, but without restriction to the particular embodiment and/or use which is shown and described for purposes of illustration, the present invention relates to a cordless, self-contained, handheld spray gun.

BACKGROUND OF THE INVENTION

Electrically and pneumatically driven compressed air spray paint guns are well known. Such spray guns are used in the efficient painting of articles. These conventional spray paint guns are typically part of a painting system. These painting systems may include a tank or container in which the paint is stored and a pump which compresses air and delivers the air through a hose to the spray paint gun wherein the compressed air atomizes and forces the paint through a nozzle. Typically, the paint containers are located below the paint gun and paint is drawn through a tube into the gun handle or barrel to a chamber in communication with the nozzle. Pressure differentials are sometimes used to draw the paint or fluid to the chamber that is in communication with the nozzle. Alternatively, paint or liquid may be drawn or pumped through a long tube into the paint gun from a tank or can located away from the paint gun. The amount of paint spray directed through the nozzle of the gun can be varied using a trigger coupled to a volume regulator. Adjusting a valve mechanism or pressure regulator is operable to vary the fan and amount of paint through the nozzle. There are certain disadvantages and limitations associated with using these conventional paint systems. The primary disadvantage is that the spray guns are tethered by long tubes adapted to transport either compressed air or paint or other fluid to the paint gun, greatly reducing their mobility.

Cordless handheld power tools, such as cordless power drills, cordless power saws and cordless power sanders, including with interchangeable battery units, are widely known in the art. These cordless power tools were developed to allow the user thereof increased mobility in their use.

SUMMARY OF THE INVENTION

What is desired is a cordless, self-contained, handheld spray gun that allows the user thereof increased mobility when painting articles. The cordless, self-contained, handheld spray gun of the present invention is an integral, portable unit operable to atomize fluids of varying viscosities, such as paints, primers, stains, varnishes, sealants and the like. The cordless, self-contained, handheld spray gun is adapted to provide the user thereof with optimum mobility. The present invention comprises a cordless, self-contained, handheld spray gun. As described in more detail herein, fluid, such as paint, primer, stain, varnish, sealant or the like, through the force of gravity, assisted by air pressure from the source of pressurized gas, is made to flow to a fluid chamber. The spray gun is actuated by pulling a trigger that permits the fluid, such as paint, to be released from the fluid chamber onto a nozzle tip on a nozzle assembly. The application of a pressurized gas, such as air, from the source of pressurized gas through a plurality of tubular members to the nozzle assembly having gas nozzle orifices and at least one fluid nozzle orifice, atomizes the fluid and directs to the article to be painted.

FIGURES OF THE INVENTION

Figure 2:
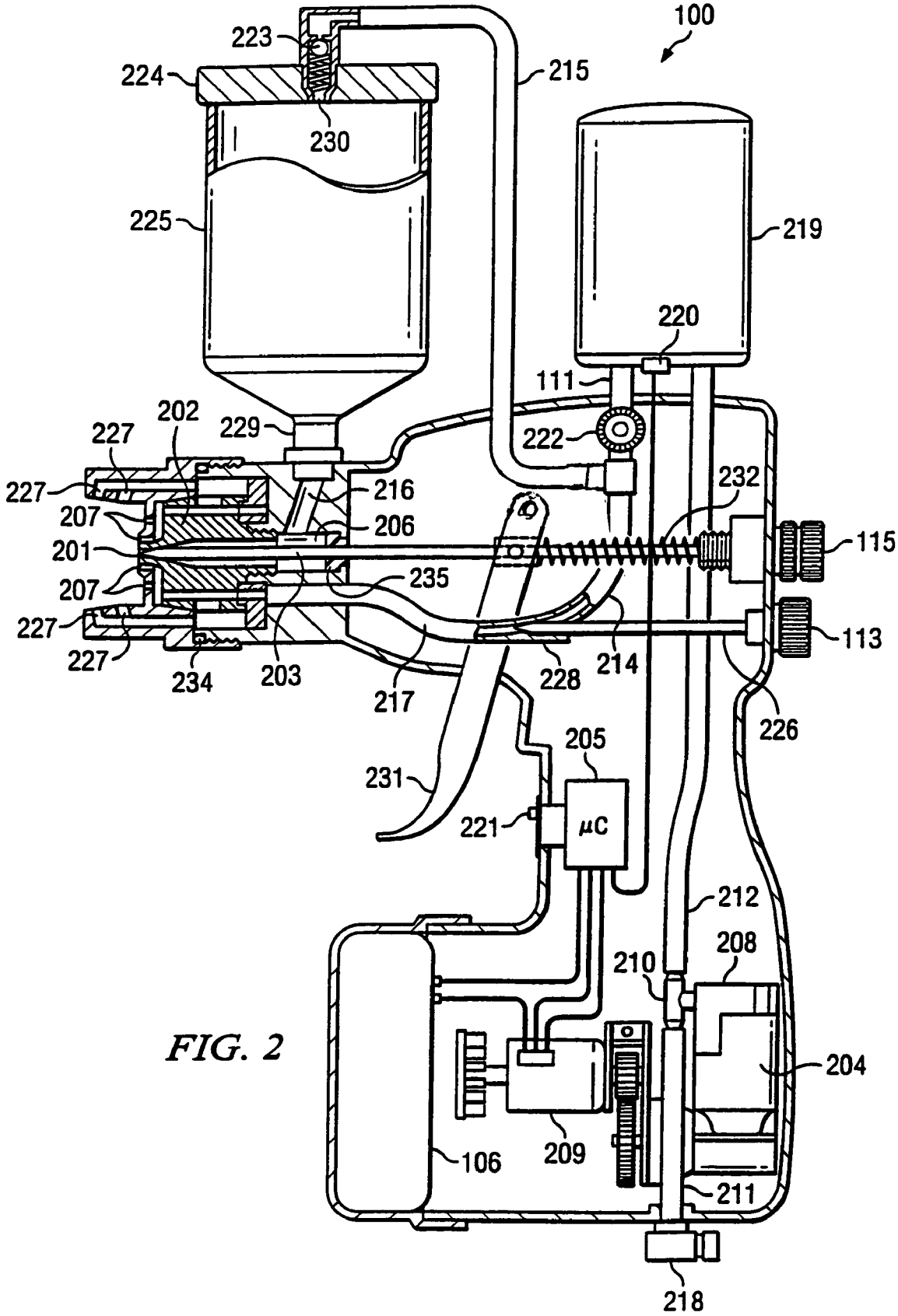

For a better understanding of the present invention including its features, advantages and specific embodiments, reference is made to the following detailed description along with accompanying drawings in which:

FIG. 1 depicts a side view of the cordless, self-contained, handheld spray gun of the present invention; and FIG. 2 depicts a cut-away side view of the cordless, self-contained, handheld spray gun of the present invention.

DETAILED DESCRIPTION OF THE INVENTION

As seen in FIG. 1, the cordless, self-contained, handheld spray gun of the present invention has a typical gun body shape. More specifically, gun body 100 has a barrel portion 101 defined by a longitudinal first end 102 a longitudinal second end 103, a lateral first end 104 and lateral second end 105. Lateral second end 105 has a base portion adapted to receive a source of power, such as a battery 106. Also formed in gun body 100 is a paint container bore 107 proximate the longitudinal first end 102 through which an end of a paint container 108 is disposed, and air reservoir bores 109 through which air reservoir inlet 110 and air reservoir outlet 111 are disposed. Further formed in gun body 100 is fan control bore 112 through which fan control knob 113 is disposed and fluid control bore 114 through which fluid control mechanism 115 is disposed. A fluid nozzle assembly 116 is formed at, and coupled to, the end of longitudinal first end 102. Fluid nozzle assembly 116 can be adapted to be screwed onto the longitudinal first end 102. As seen in FIG. 2, an O-ring 234 located between the fluid nozzle assembly 116 and gun body 100 is adapted to keep fluid, such as paint, from exiting between the fluid nozzle assembly 116 and the gun body 100.

Gun body 100 has a longitudinal central passage defined from the longitudinal first end 102 to the longitudinal second end 103 and a latitudinal central passage defined from the lateral first end 104 to the lateral second end 105. Gun body 100 also has a handle portion 117 defined by an interval between the lateral first end 104 and a lateral second end 105. The longitudinal first end 102 and longitudinal second end 103 are integral with, but orthogonal to said lateral first end 104 and lateral second end 105. The longitudinal first end 102 is located generally 90 degrees from the lateral second end 105.

Referring again to FIG. 2, nozzle assembly 116 has a fluid nozzle orifice 201 defined there-through. Nozzle assembly 116 has a mechanism operable to adjust the amount and shape of the fluid drawn from fluid nozzle orifice 201. The mechanism comprises a valve member 202 with an bore there-through, and an adjustable needle 203 extending through the bore of valve member 202 proximate fluid nozzle orifice 201. Adjustable needle 203 can be adjusted to an open, partially open or closed position by adjusting fluid control knob 115. Fluid control knob is operable to manipulate the position of the adjustable needle 203 in relation to a valve seat on valve member 202. Alternatively, the mechanism may includes a reciprocable valve member engageable with the valve seat to close the fluid nozzle orifice Further referring to FIG. 2, in gun body 100 is a source of pressurized gas. The source of pressurized gas can be an electrically driven air compressor or a cartridge operable to hold a compressed gas. As seen in FIG. 2, an electrically driven piston pump 204 is coupled through micro-processor 205 to battery 106. The source of pressured gas may be designed or made adjustable to provide a variety of pressures, depending, for example, on the viscosity of the fluids to be ejected through the nozzle. For example, in one embodiment, the pressure may be no more than 10 psi so as to comply with certain EPA regulations concerning HVLP. In another embodiment, the pressure may be up to approximately 135 psi. The pressurized gas exits gas nozzle orifices 207 and fan nozzle orifices 227 and draws the fluid out of fluid chamber 206 through fluid orifice 201 and atomizes the fluid as a spray.

In the disclosed embodiment, the source of pressurized gas comprises an electrically driven air compressor system. Electrically driven compressor has a motor 209 with a means of transforming angular motion to linear motion, a piston pump 204 comprising a piston, a piston chamber, and a system of intake and exhaust valves. A one way valve mechanism 208 at output of the piston pump 204 is operable to allow pressurized gas to exit the piston pump 204. In this manner, compressed gas can leave the piston chamber on each upward piston stroke, and is not drawn back into the chamber on each downward stroke.

Further FIG. 2 discloses a network of interconnected tubular members adapted to move compressed air from the source thereof to the nozzle assembly 116. There is a first junction 210 interconnecting first tubular member 211 and second member 212. A bypass valve 218 at an end of first tubular member is adapted to allow the connection of an external source of pressurized gas, such as air from a conventional air compressor, into network of interconnected tubular members in gun body 100. Second tubular member 212 comprises a passage for a gas such as air. It couples the source of pressurized gas to an air reservoir tank 219. A sensor 220 coupled to microprocessor 205 is adapted to sense when a pre-determined air pressure in the tank 219 is detected. Microprocessor is manually switched on using switch 221 by the user of the spray gun. When the pressure is below a certain level, and the switch 221 is on, the piston pump 204 is operable to pump gas, such as air, though second tubular member 212 into reservoir 219. The air reservoir inlet 110 would have a one way valve operable to allow a compressed gas as air to enter into air reservoir, but not to escape from the air reservoir 219. When the pressure in air reservoir 219 is sensed to reach a certain level, then microprocessor 205 is directed to switch off piston pump 204. Once the air pressure is at a certain level, painting can commence. A third tubular member, air reservoir outlet 111 also comprising a passage for a gas, such as air, intercommunicates with pressure regulator valve 222, through a junction and into fourth tubular member 214 and fifth tubular 215. Fifth tubular member feeds pressurized air through one-way ball valve 223 on fluid container lid 224 on fluid container 225. The pressure thus fed is operable to maintain constant pressure on the fluid that is being fed through sixth tubular member 216 into fluid chamber 206. Sixth tubular member 216 comprises a passage for a fluid, such as paint, primer, stain, varnish, sealer and the like. Fourth tubular member 214 and seventh tubular member 217 meet at Y junction 228, through which pressure needle 226 is disposed. The adjustment of pressure needle 226 using fan control knob 113 is operable to increase or decrease the gas through the interconnected passages after seventh tubular member 217. By decreasing the gas pressure through seventh tubular member 217, less gas is introduced through fan nozzle orifice 227, thus decreasing the fan-out of the sprayed fluid. When fully closed, no compressed gas, such as air, is introduced into the nozzle assembly, and hence no fluid, such as paint can be sprayed from the spray gun. In operation, when a fluid, such as paint of varnish or the like, is introduced into fluid chamber 206 through sixth tubular member 216, and gas pressure is introduced through gas nozzle orifices 207 and fan nozzle orifices 227, at nozzle assembly 116, the fluid, such as paint, is atomized and drawn through fluid nozzle orifice 201 and can be sprayed.

A regulator may be installed in series with any of the tubular members, seen as regulator 222, operable to adjust the rate of gas through said tubular members. A means of adjusting the spray pattern at nozzle assembly 116 includes fan control knob 113 and fan control needle 226 wherein fan control knob 113 is connected to fan control needle 226. Fan control knob 113 is coupled through a bore in the longitudinal second end 103 of the gun body 100. When pressure through Y junction 228 is modified, the gas through gas nozzle orifices 207 and fan nozzle orifices 227 are modified, thus modifying the fan out of the fluid spray.

As further seen in FIG. 2, gravity fed fluid container 225 is located near the top of gun body 100. Container 225 can have any variety of parallelepiped or cylindrical shapes, with a plurality of closed sides and an open top and a bottom with an opening therein. As used herein, the terms top, bottom and side are only meant to convey the general relative locations of these components with respect to each other. The use of these terms is not meant to necessarily imply a specific planar surface shape. The bottom 229 of the fluid container 225 is adapted to attach securely to the top of the gun body 100 proximate the longitudinal first end 102, using a coupling means, such as a the container bottom 229 being threaded and screwed onto a threaded inlet bore 107, or securely clamped thereon using a hose clamp mechanism, or snap in place mechanism. The means of coupling the fluid container 225 to the gun body 100 must create an impervious seal between the fluid container 225 and the inlet bore 107 of the gun body 100 so as to prevent leaks of the fluid placed in the fluid container 225. A fluid container covering 224 mates to the open top of the fluid container 225. The fluid container covering 224 has a bore 230 through the top thereof. The second end of the fifth tubular member 215 being coupled, through ball valve 223, to the container covering 224 bore 230. The first end of the sixth tubular member 216 is coupled and in communication with the bottom 229 of the fluid container 225 through the inlet bore 107 in the top of the gun body 100. The second end of the sixth tubular member 216 terminates at the fluid chamber 206.

Further referring to FIG. 2, a trigger mechanism is shown located proximate the handle portion of the gun 100. The trigger mechanism comprises a pivot point pivotably coupling trigger 231 to gun body 100. The trigger mechanism is adapted to retract needle 203 from being seated on fluid nozzle orifice 210, thus opening fluid nozzle orifice 201. A spring biasing means 232 is used for biasing the needle 203 toward a closed position. The trigger mechanism has a variable pull such that the orifice opens variably form a closed to full open, depending on the force applied to the trigger 231. A seal 235, such as a rubber seal, is placed at the end of fluid chamber 206 to keep paint from entering open recess of gun body 100.

As noted herein, in the disclosed embodiment of the present invention, the source of pressurized gas is a battery powered air compressor and the gas that is output from source of pressurized gas is air, comprising about 80% nitrogen and 20% oxygen. The batteries can comprise one or more disposable batteries or one or more rechargeable batteries, such as NiCad or L-Ion type batteries. Battery 116 is shown as being a modular snap on type that can be removed from the gun body 100 for recharging. In such embodiment, the compressed air pump comprises a motor, a means of transforming angular motion to oscillating linear motion, a piston, a chamber for accepting the piston, and the chamber having valves for accepting air and expelling air. In the disclosed embodiment, switch 221 is operable to control a microprocessor circuit coupled to the pressure sensor and the motor, thus providing power to the motor.

In a different embodiment of the present invention, the source of pressurized gas is a compressed gas cartridge and the gas that is output from source of pressurized gas is CO2. In the gas cartridge embodiment, the trigger switch is a valve release that opens a valve releasing compressed gas from the source of pressurized gas.

In one embodiment of the present invention, the fluid container 225 is a single plastic polypropylene paint cup. Alternatively, the fluid container may comprise a single light-weight metal or alloy container, such as an aluminum container. However, the use of a single container is not limiting. By using a plurality of containers feeding paint and catalysts into the junction near the nozzle, the cordless spray gun of the present invention can be adapted to the spraying of fast-drying paint mixtures while preventing the polymerization of the paint mixture in a single paint container.

While the invention has been described in the specification and illustrated in the drawings with reference to one or more preferred embodiments, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims. For example, the present invention can be tailored to allow the application of fluids with varying viscosities, such as paints, primers, stains, varnishes, sealants and the like. In addition, the present invention may be fabricated from any number of components made from materials such as metal, metal alloys, plastic, polypropylene or other similar material. Various alterations, modifications and substitutions can be made to the disclosed invention without departing in any way from the spirit and scope of the invention.

What is claimed is:

1. A self contained, cordless, handheld spray gun, comprising:

a gun body;

a power source internal to the gun body;

a source of compressed gas internal to the gun body;

an air reservoir coupled to said gun body;

a pressure sensor coupled to the air reservoir;

a gas nozzle assembly with at least one gas nozzle orifice, said gas nozzle assembly able to regulate the gas flow and gas pressure at the gas nozzle orifice;

a first tube assembly coupling the source of compressed gas to the gas nozzle assembly;

a container for holding fluids appurtenant to the gun body;

a fluid chamber;

at least one fluid nozzle orifice at an end of the fluid chamber;

a second tube assembly for coupling the container for holding fluids to the chamber; and a trigger having a variable pull such that the at least one fluid nozzle orifice opens variably from closed to full open, depending on the force applied to the trigger.

2. The self-contained, cordless, handheld spray gun of claim 1, wherein the container for holding fluids is adapted to hold paint.

3. The self-contained, cordless, handheld spray gun of claim 1, wherein the source of compressed gas is an internal, electrically driven piston pump.

4. The self-contained, cordless, handheld spray gun of claim 3, further comprising:

a microprocessor with at least an input and output;

the input to the microprocessor coupled to the pressure sensor;

the output from the microprocessor coupled to the piston motor;

the microprocessor operable to turn on the piston motor when the pressure sensor senses pressure in the reservoir at a first predetermined level; and the microprocessor operable to turn off the piston motor when the pressure sensor senses pressure in the reservoir at a second predetermined level.

5. The self-contained, cordless, handheld spray gun of claim 1, wherein one or more valves and regulators are placed in series with at least one of the first and second tube assemblies adapted to control the pressure of the gas introduced at the gas nozzle orifices.

6. The self-contained, cordless, handheld spray gun of claim 1, wherein the gas nozzle assembly further comprises fan nozzle orifices in intercommunication with the first tube assembly.

7. The self-contained, cordless, handheld spray gun of claim 6, further comprising a fan control assembly to adjust fan out.

8. A self-contained, cordless, handheld spray gun, comprising:

a gun shaped body having a barrel portion defined by a longitudinal first end and a longitudinal second end, said gun body having a central passage defined through said longitudinal first end to said longitudinal second end and having a first bore defined at the first longitudinal end, an inlet bore at the top of the gun body proximate the longitudinal first end:

said gun shaped body also having a handle portion defined by a lateral first end and a lateral second end, said body having a central passage defined from the lateral first end to said lateral second end;

the longitudinal first end and longitudinal second end being integral with, but generally orthogonal to, said lateral first end and lateral second end;

the longitudinal first end being about 90 degrees away from said lateral first end;

a nozzle assembly connected to said gun body at said first longitudinal end;

at least one fluid nozzle orifice defined therethrough the nozzle assembly;

a valve mechanism coupled to the fluid nozzle;

said valve mechanism operable to adjust the aggregate size of the fluid orifice;

at least one tubular member comprising air passages;

at least one tubular member comprising fluid passages;

a source of pressurized gas;

an air reservoir coupled to said gun body;

a pressure sensor coupled to the air reservoir;

a fluid chamber;

at least one gas nozzle orifice defined therethrough the nozzle assembly, said nozzle assembly able to regulate the gas flow and gas pressure at the gas nozzle orifice;

the at least one tubular member comprising air passages commencing from the source of pressurized gas and terminating at the at least one gas nozzle orifice;

a fluid container having a plurality of closed sides and an open top and a bottom;

the bottom of the fluid container having a bore there-through and being adapted to attach securely to the top of the gun body proximate the longitudinal first end;

the bottom of the fluid container being adapted to securely mate with the inlet bore in the top of the gun body;

a fluid container covering, adapted to mate to the open top of the fluid container;

the fluid container covering having a container covering bore through the top thereof;

the at least one tubular member comprising fluid passages being coupled and in communication with the fluid container through the bottom bore of the container and the inlet bore in the top of the gun body;

the at least one tubular member comprising fluid passages commencing from the fluid container and terminating at the fluid chamber and in communication with the fluid nozzle;

the air passage tubular members being coupled to the container covering bore on the top of the fluid container covering;

a trigger mechanism located proximate the handle portion of the gun body; and the trigger mechanism having a variable pull such that the at least one fluid nozzle orifice opens variably from closed to full open, depending on the force applied to the trigger mechanism.

9. The self-contained, cordless, handheld spray gun of claim 8, further comprising an electrically driven portable compressed air pump as the source of pressurized gas.

10. The self-contained, cordless, handheld spray gun of claim 9, wherein the portable compressed air pump is powered with one or more batteries.

11. The self-contained, cordless, handheld spray gun of claim 9, wherein the portable compressed air pump is powered with one or more rechargeable batteries.

12. The self-contained, cordless, handheld spray gun of claim 9, further comprising a microprocessor with at least an input and output;

the input to the microprocessor coupled to the pressure sensor;

the output from the microprocessor coupled to the air pump;

the microprocessor operable to turn on the power source to the air pump when the pressure sensor senses pressure in the reservoir at a first predetermined level; and the microprocessor operable to turn off the power source to the air pump when the pressure sensor senses pressure in the reservoir at a second predetermined level.

13. The self-contained, cordless, handheld spray gun of claim 9, further comprising a one way valve mechanism in communication with, and at the output of, the source of pressurized gas.

14. The self-contained, cordless, handheld spray gun of claim 9, further comprising the placement of a regulator in series with any of the air passage tubular members operable to regulate the rate of gas or fluid flow there-through.

15. The self-contained, cordless, handheld spray gun of claim 8, wherein the fluid container is adapted to hold paint.

16. The self-contained, cordless, handheld spray gun of claim 8, wherein the fluid container is adapted to hold primer.

17. The self-contained, cordless, handheld spray gun of claim 8, wherein the fluid container is adapted to hold varnish.

18. The self-contained, cordless, handheld spray gun of claim 8, wherein the fluid container is adapted to hold sealant.

* * * * *